US009759065B2

(12) United States Patent
Helbig et al.

(10) Patent No.: US 9,759,065 B2
(45) Date of Patent: Sep. 12, 2017

(54) MINE VENTILATION SYSTEM AND METHOD

(71) Applicants: Courtland Joshua Helbig, Morgantown, WV (US); Timothy Dale Beeman, Lonaconing, MD (US); David William Lantz, III, Oakland, MD (US)

(72) Inventors: Courtland Joshua Helbig, Morgantown, WV (US); Timothy Dale Beeman, Lonaconing, MD (US); David William Lantz, III, Oakland, MD (US)

(73) Assignee: GMS MINE REPAIR AND MAINTENANCE, INC., Lake Park, MD (US)

( * ) Notice: Subject to any disclaimer, the term of this patent is extended or adjusted under 35 U.S.C. 154(b) by 510 days.

(21) Appl. No.: 14/271,476

(22) Filed: May 7, 2014

(65) Prior Publication Data

US 2015/0322787 A1 Nov. 12, 2015

(51) Int. Cl.
*E21F 1/00* (2006.01)
*E21F 1/14* (2006.01)

(52) U.S. Cl.
CPC ..... *E21F 1/14* (2013.01); *Y10T 29/49631* (2015.01)

(58) Field of Classification Search
CPC ..... E21F 1/14; E24F 1/14; E24F 1/145
USPC ..... 454/168, 169
See application file for complete search history.

(56) References Cited

U.S. PATENT DOCUMENTS 5,174,682 A * 12/1992 Whitfield ..... E21F 1/14 405/132
5,412,916 A * 5/1995 Kennedy ..... E21F 1/14 405/132
5,466,187 A * 11/1995 Kennedy ..... E21F 1/14 405/153
5,879,231 A * 3/1999 Sisk ..... E21F 1/14 405/132
6,129,483 A * 10/2000 Juracko ..... E21F 1/14 405/132
6,256,946 B1 * 7/2001 Kennedy ..... E04F 11/0255 52/183
6,264,549 B1 * 7/2001 Kennedy ..... E21F 1/14 405/153
7,182,687 B2 * 2/2007 Kennedy ..... E21F 1/14 454/168
7,232,368 B2 * 6/2007 Kennedy ..... E21F 1/14 405/132
8,220,094 B2 * 7/2012 Kennedy ..... E01D 15/133 14/6
2003/0129937 A1 * 7/2003 Kennedy ..... E21F 1/14 454/169
2004/0067730 A1 * 4/2004 Kennedy ..... E21F 1/14 454/169
2006/0105695 A1 * 5/2006 Kennedy ..... E21F 1/14 454/169

(Continued)

*Primary Examiner* — Steven B McAllister
*Assistant Examiner* — Jonathan Cotov
(74) *Attorney, Agent, or Firm* — Porter Wright Morris & Arthur LLP

(57) ABSTRACT

A mine ventilation structure including a support structure, a plurality of side panels and ceiling panels mounted on the support structure, and a cementitious sealing composition applied over at least one surface of the side or ceiling panels. A method of assembling an overcast in an intersection within a mine is also provided.

16 Claims, 18 Drawing Sheets

(56) References Cited

U.S. PATENT DOCUMENTS

| | | | | |
|---|---|---|---|---|
| 2006/0172683 | A1* | 8/2006 | Kennedy | E21F 1/14<br>454/169 |
| 2007/0297861 | A1* | 12/2007 | Sisk | E21F 17/103<br>405/259.1 |
| 2014/0308079 | A1* | 10/2014 | Hamrick | E04C 2/06<br>405/153 |

* cited by examiner

MINE VENTILATION SYSTEM AND METHOD

BACKGROUND

Underground mining (e.g., coal mining) typically necessitates the cutting of intersecting passageways throughout the mine. These intersecting passageways are often arranged in a grid pattern, with the passageways intersecting at right angles. In addition to providing access, the passageways are also used for ventilation purposes. Some passageways are used to deliver fresh air into the mine while others to expel contaminated air from the mine. Where a fresh air passageway intersects a contaminated air passageway it is necessary to prevent mixing of the two air streams.

An overcast (also referred to as an undercast) is a structural system that is typically utilized in a mine or tunnel ventilation system. The structure is constructed in a mine intersection for the purpose of preventing the mixing of the ventilation air and contaminated air at an intersection. Overcasts, however, can be time-consuming to assemble in place, and must be sized for the particular intersection. In addition, it can be difficult to provide sufficient sealing between the overcast and the mine ribs to prevent or limit mixing of ventilation air and contaminated air.

While a variety of devices and techniques may exist for providing overcast structures in mines, it is believed that no one prior to the inventors have made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings, like numerals represent like elements throughout the several views.

Figure 1:
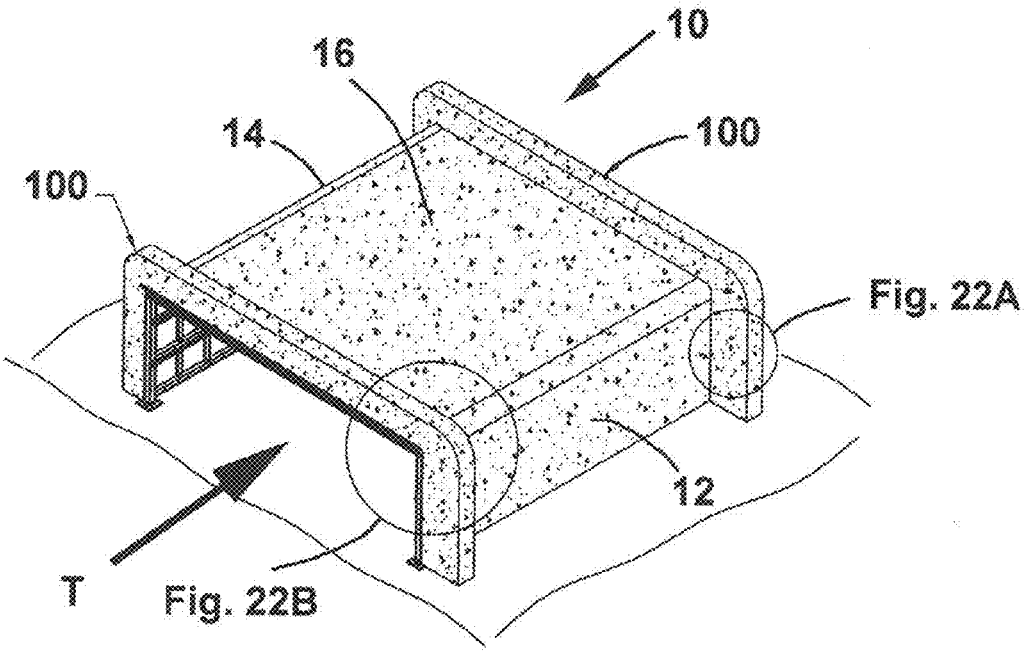
FIG. 1 depicts one embodiment of a mine ventilation structure.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples should not be used to limit the scope of the present invention. Other features, aspects, and advantages of the versions disclosed herein will become apparent to those skilled in the art from the following description, which is by way of illustration, one of the best modes contemplated for carrying out the invention. As will be realized, the versions described herein are capable of other different and obvious aspects, all without departing from the invention. Accordingly, the drawings and descriptions should be regarded as illustrative in nature and not restrictive.

Mine ventilation systems and methods are described herein. In one embodiment, the ventilation system comprises an overcast structure which is constructed out of a prefabricated metal frame and preformed metal panels that fit and interlock together to form the walls and roof deck of the overcast structure. The overcast structure is configured to fit the applicable intersection, as irregularities of the mine or tunnel leads to varying dimensions of intersections.

The overcast structure is assembled in place within the intersection, and then a cementitious sealing composition is applied to the exterior of the structure in order to provide additional sealing as well as strength. For example, shotcrete or gunite is applied to the outer surface of the overcast in order to not only seal the structure, but also to span any gaps between the structure and the ribs and ceiling defining the passageways in which the structure is positioned. In some embodiments, wire mesh is first applied over some or all of the outer surfaces of the side and ceiling panels of the structure to facilitate adherence of the cementitious sealing composition.

In addition, some embodiments also include one or more sealing flanges which extend away from portions of the structure in order to span gaps between the side and/or ceiling panels of the overcast and the ribs and/or ceiling of the mine passageways. In some embodiments, these sealing flanges comprise foraminous preform structures which are affixed to the structure about the ends thereof and thereafter the cementitious sealing composition is applied to the preform structure. In particular embodiments, the preform structures used to fabricate the sealing flanges are formed from foraminous metal structures (e.g., expanded metal panels). The cementitious sealing composition is applied over the expanded metal panels to provide sealing. Embodiments of the ventilation structures and methods described herein take less man hours to build, are safer to construct, and/or provide reduced air leakage.

Figure 2:
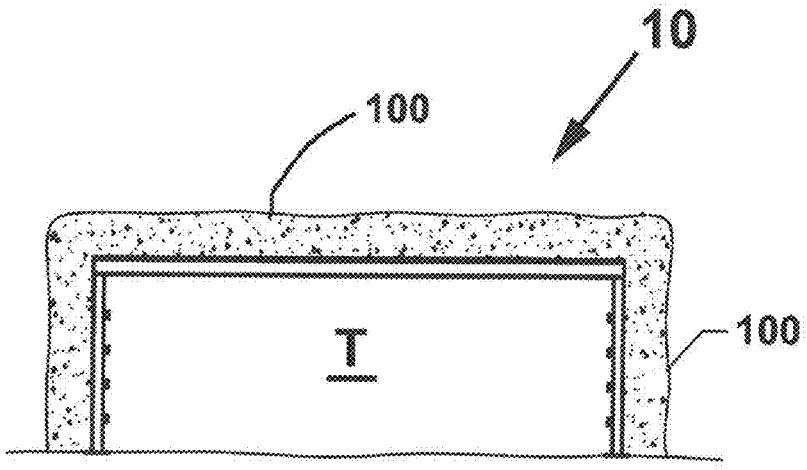
FIG. 2 depicts an end view of the mine ventilation structure of FIG. 1.
Figure 3:
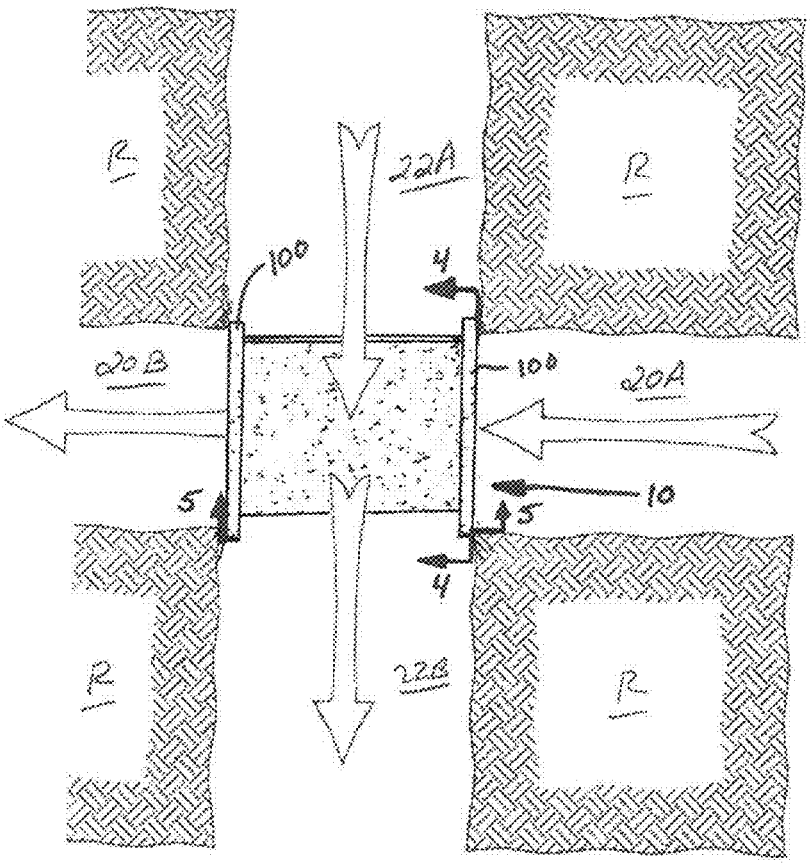
FIG. 3 depicts a top schematic view of the mine ventilation structure of FIG. 1, installed at the intersection of two mine passageways within a mine.
Figure 4:
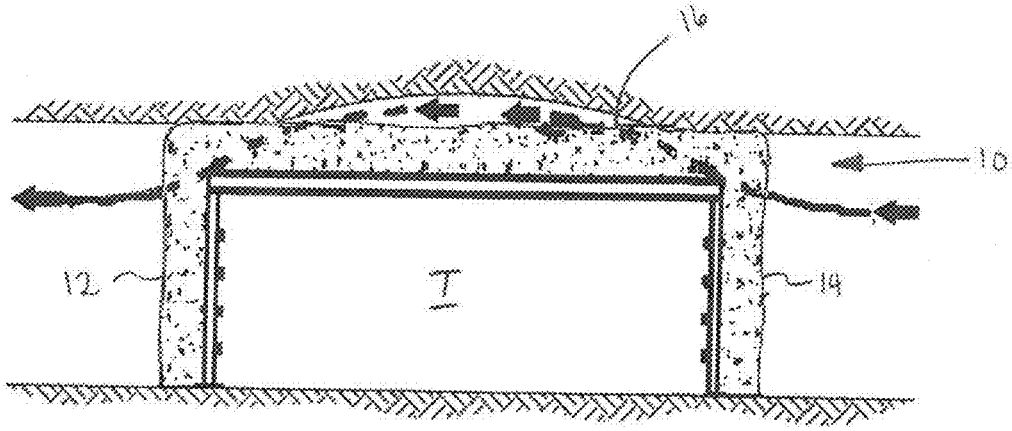
FIG. 4 depicts an end schematic view of the mine ventilation structure installation of FIG. 3, taken along the line 4-4 thereof, wherein the ribs (R) of the mine passageways have been omitted for purposes of clarity.
Figure 5:
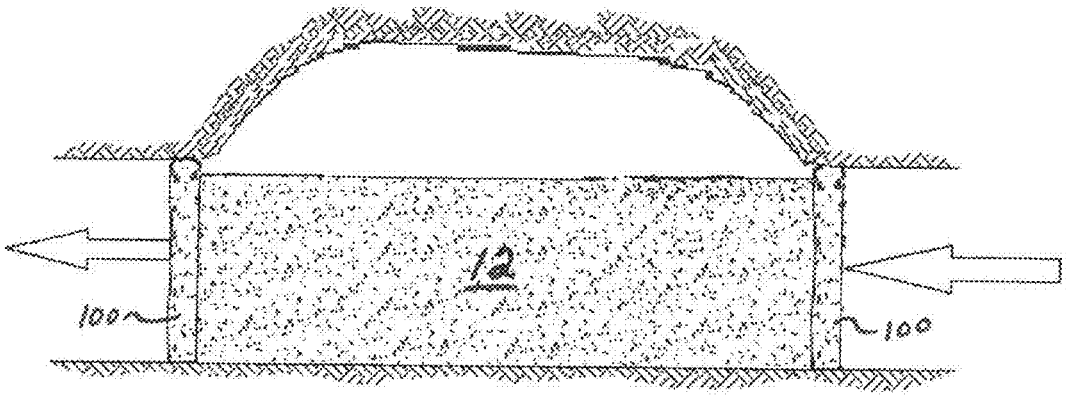
FIG. 5 depicts a side schematic view of the mine ventilation structure installation of FIG. 3, taken along the line 5-5 thereof, wherein the ribs (R) of the mine passageways have been omitted for purposes of clarity.

FIGS. 1 and 2 depict one embodiment of an assembled and coated overcast system (10) having opposing sidewalls (12, 14) and a roof (16) spanning between the sidewalls. A tunnel T is thus provided between the sidewalls (12, 14), beneath roof (16), extending between openings located at opposite ends of the overcast system (10). FIG. 3 depicts a top schematic view of overcast system (10) of FIGS. 1 and 2 installed at the intersection of mine passageways (20, 22), such that air flowing through first passageway (20A, 20B) will flow through the tunnel (T) of the overcast system (beneath roof (16)) and air flowing through second passageway (22A, 22B) will flow over roof (16) of overcast system (10). FIG. 4 is an end view of the installation of FIG. 3, taken along the line 4-4 thereof. Overcast system (10) is installed within the intersection of mine passageways (20, 22) in sealing engagement with the ribs (R) of the mine passageways as well as portions of the roof of the passageways. In this manner, overcast system (10) prevents mixing of the air flowing through the first passageway (20) with the air flowing the second passageway (22).

Overcast system (10) shown in FIGS. 1-5 includes a cementitious sealing composition applied to the exterior of the structure in order to provide additional sealing (e.g., to seal gaps between adjacent side and ceiling panels) as well as improved structural integrity and strength. In fact, as further described herein, the cementitious coating provides sufficient strength to allow to the upper surface of the overcast structure to be used as a walkway.

Figure 6:
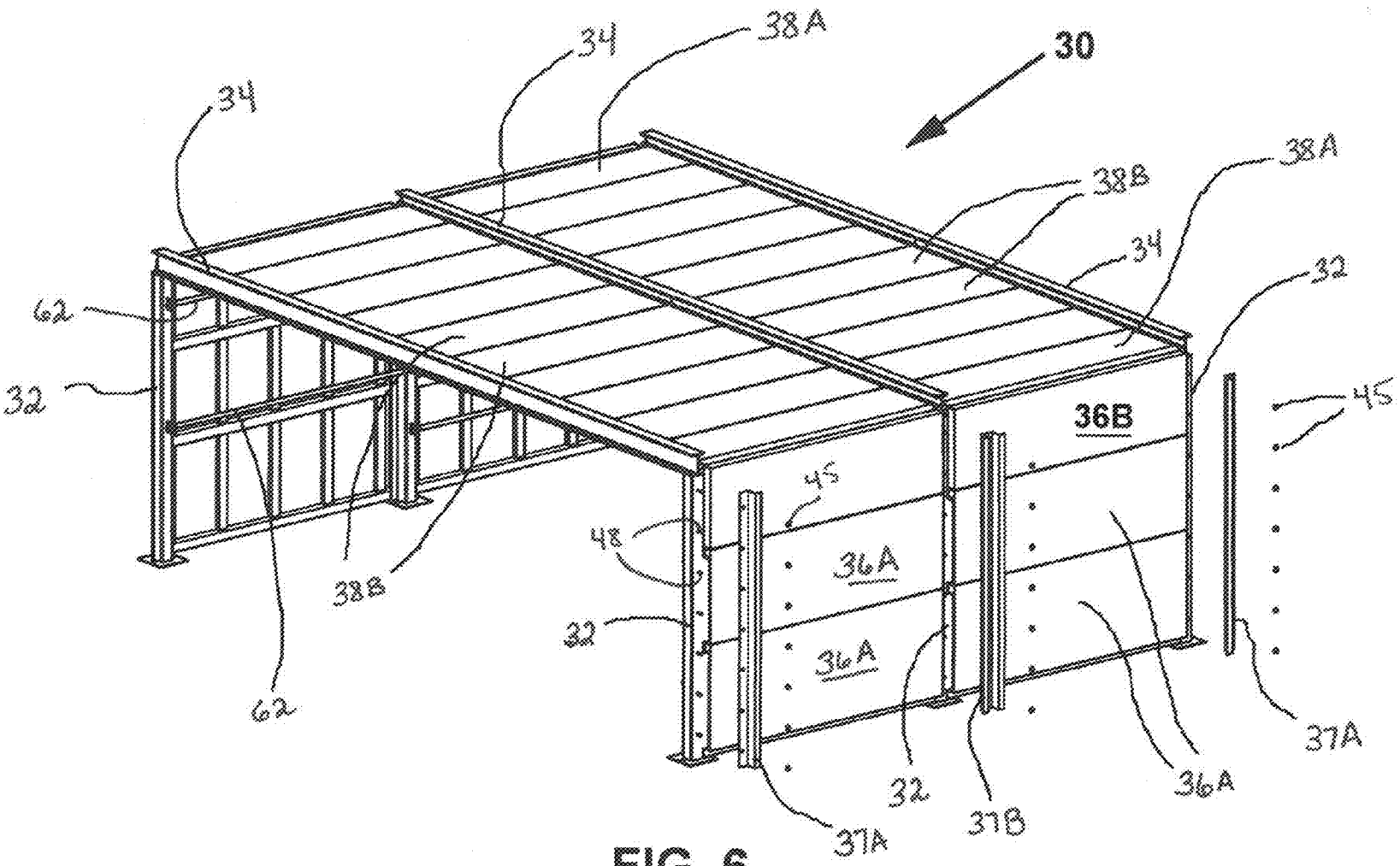
FIG. 6 depicts the metal framework of the mine ventilation structure of FIG. 1, prior to the application of the cementitious sealing composition, also showing the assembly of the panel retention brackets.

Underlying the sealing composition is a rigid, metal framework (30), as shown in FIG. 6. Metal framework (30) is fabricated from steel, however various other rigid materials, particularly other metals, may be used. Metal framework (30) generally comprises a plurality of vertically extending support columns (32), a plurality of cross beams (34) extending across the width of the metal framework so as to connect pairs of support columns (32) at their upper ends, a plurality of side panels (36) extending between adjacent support columns (32) along the sides of the framework (30), and a plurality of ceiling panels (38) extending between adjacent cross beams along the top of the framework. Panel retention brackets (37A, 37B) are used to secure the side panels (36) in place, as further described herein.

FIGS. 7-20 depict additional details of one embodiment of metal framework (30) and the manner in which the framework is assembled. In the embodiment shown, the framework is assembled using six support columns (32A-32F), and three cross beams (32A, 32B). An outer cross beam (34A) spans between support columns (32A, 32D) and another outer cross beam (34B) spans between support columns (32C, 32F). A central cross beam (34B) spans between support columns (32B, 32E). It will be understood, however, that any number of pairs of support columns and spanning cross beams may be employed, depending on the size of the overcast system needed for a mine intersection. It will also be noted that FIGS. 7-20 depict a framework having two rows of side panels (36) and twelve ceiling panels (38), rather than the three rows of side panels (36) and twenty ceiling panels (38) in the embodiment shown in FIG.

6. However, the side panels and ceiling panels of FIGS. 7-20 are constructed and assembled similarly to the system of FIG. 6.

Figure 8:
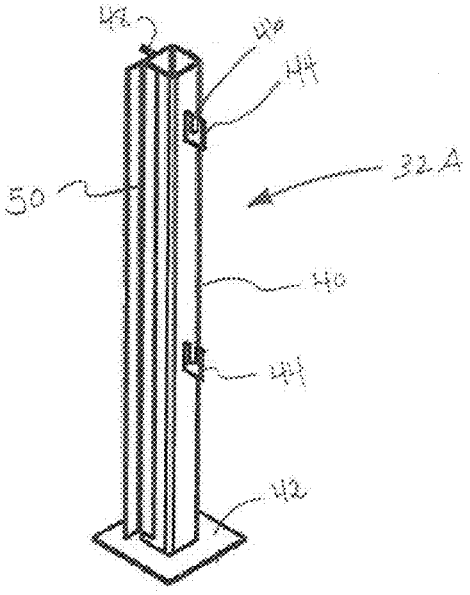
FIG. 8 depicts a perspective view of a support column of the support structure shown in FIG. 7.
Figure 9A:
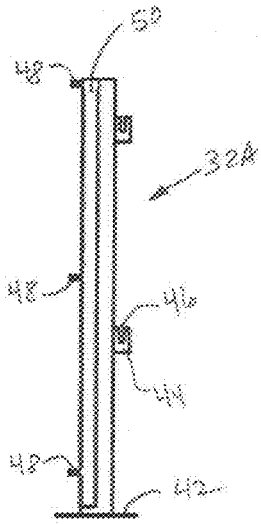
FIGS. 9A-9C depict side views of first, second and third support columns.

Support column (32A) is depicted in FIG. 8, and generally comprises an elongate tubular member (40) supported by a base plate (42). Tubular member (40) has, for example, a square or rectangular cross-section. A pair of retention tabs (44) extend away from one face of the tubular member (40), at predetermined heights. Each retention tab (44) includes a U-shaped channel (46) for receiving a securement rod therein (as further described below). Three threaded panel mounting studs (48) extend away from the opposite side of the tubular member (40), as best seen in FIG. 9A. A panel support flange (50) is also provided on the side of the tubular member having the mounting studs (48). Support flange (50) comprises angle iron welded to the tubular member (40), and extends nearly the entire length of the tubular member (40). Support column (32D) is essentially a minor image of support column (32A). It will be understood that any number of retention tabs (44) and mounting studs (48) may be provided on the support columns (32), depending in part on how many rows of side panels (36) are provided on the framework (30). For example, in the embodiment of FIG. 6, seven threaded mounting studs (48) are provided on each support column (32).

Figure 9B:
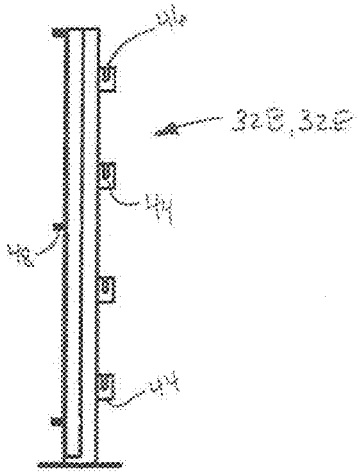
Figure 9C:
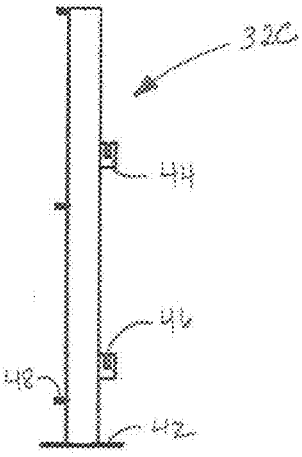
Figure 10:
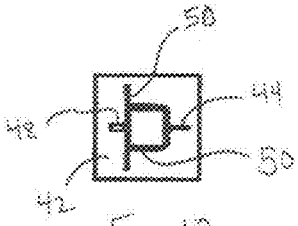
FIG. 10 is a top plan view of the support column of FIG. 9B.
Figure 11:
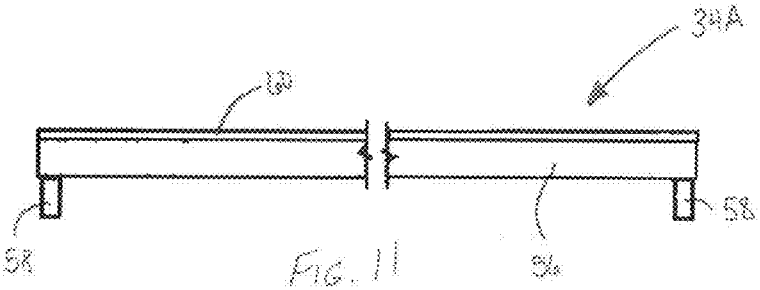
FIG. 11 is a side plan view of an outer cross beam used to support the ceiling panels in the metal framework of FIG. 7.
Figure 12:
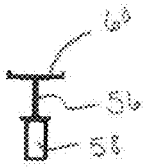
FIG. 12 is an end plan view of the outer cross beam of FIG. 11.

Support columns (32B, 32C, 32E and 32F) are of similar construction to that of support column (32A), each having three panel mounting studs (48) extending away from one side of the tubular member (40), and retention tabs (44) having U-shaped channels (46) extending away from the opposite side of the tubular member (40). However, center support columns (32B, 32E) have six retention tabs (44) spaced along the length of the tubular member (40), as seen in FIG. 9B. Two of the retention tabs (44) on support column (32B, 32E) are aligned with the retention tabs (44) on support column (32A, 32D), while the other two retention tabs (44) on support column (32B, 32E) are aligned with the retention tabs (44) on support column (32C, 32F). Center support columns (32B, 32E) also have a pair of support flanges (50) welded to opposite sides thereof, as depicted in the top plan view of FIG. 10.

Figure 7:
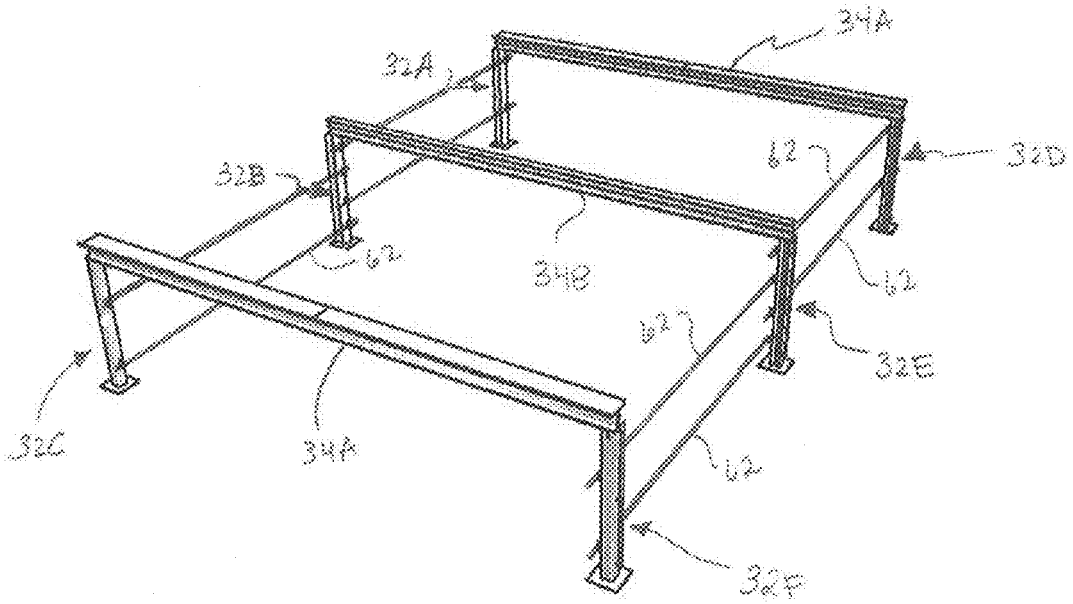
FIG. 7 depicts the support structure of the metal framework of FIG. 6, prior to attachment of the side and ceiling panels.

Turning to the cross beams (34), each comprises an I-beam (56), a flange (60) welded on top of I-beam (56), and mounting projections (58) extending downwardly away from each end of the I-beam (56). Mounting projections (58) are sized and configured to be snugly received in the upper ends of the tubular members (40) of the support columns (32), as seen in FIG. 7. While mounting projections (58) may be welded or otherwise secured within the upper ends of the support columns (32), this is generally not necessary, thereby facilitating assembly and disassembly of the overcast structure (e.g., to install the overcast at a new location).

The metal framework (30) of the overcast system (10) is delivered to the installation site within the mine in unassembled form. At the intersection within the mine where the overcast is to be installed, the support columns (32) are positioned upright in the appropriate location with each cross beam (34) mounted on a pair of support columns (32), as shown in FIG. 7. Securement rods (62) (e.g., 1" Schedule 40 steel pipe) are then positioned within the U-shaped channels (46) of the retention tabs (44) such that a securement rod (62) extends between the aligned channels (46) of adjacent pairs of support columns (32) on either side of the framework. Thus, a pair of securement rods (62) extend between vertically aligned channels (46) on support columns (32A, 32B). Securement rods (62) are used not only to secure the support columns (32) to one another, but also to adjust and square the framework.

Securement rods (62) may be secured within the channels (46) in a variety of ways. In some embodiments, securement rods (62) are adjustably securable within to the support columns (32). For example, in one embodiment, the securement rods (62) are threaded at each end, and threaded nuts are used to secure the rods (62) within the channels (46). In addition to securing the initial assembly of framework (30) prior to adding the side and ceiling panels, securement rods (62) are also used to bring the structure into proper alignment (i.e., to square or true the structure) prior to attaching the side and ceiling panels (e.g., by using the rods to pull columns away from each other such as by adjustment of the nuts used for securing the rods in place).

In the embodiment shown in FIG. 7, a pair of securement rods (62) are secured to each of the outer support columns (32A, 32C, 32D, 32F), with each extending to, and secured to, one of the center support columns (32B, 32E). If an overcast of additional length is needed such that one or more additional support columns are required, the additional support columns are configured similar to center support columns (32B, 32E), with four securement rods (62) secured thereto (preferably in staggered form, as shown in FIG. 7).

Figure 13A:
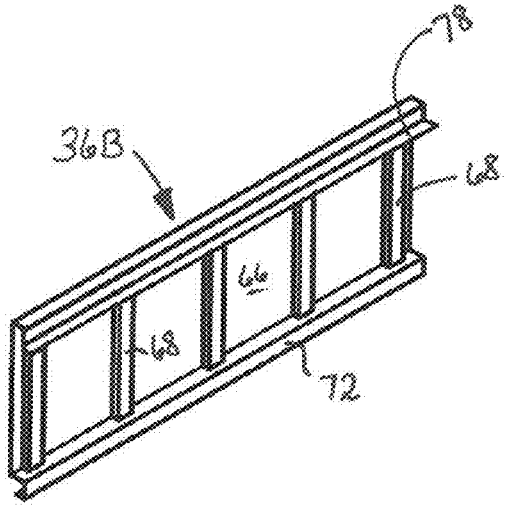
FIG. 13A depicts an upper side panel used in the metal framework of FIG. 6.
Figure 13B:
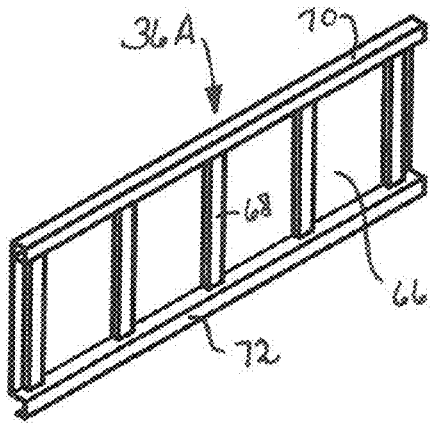
FIG. 13B depicts a lower side panel used in the metal framework of FIG. 6.
Figure 14:
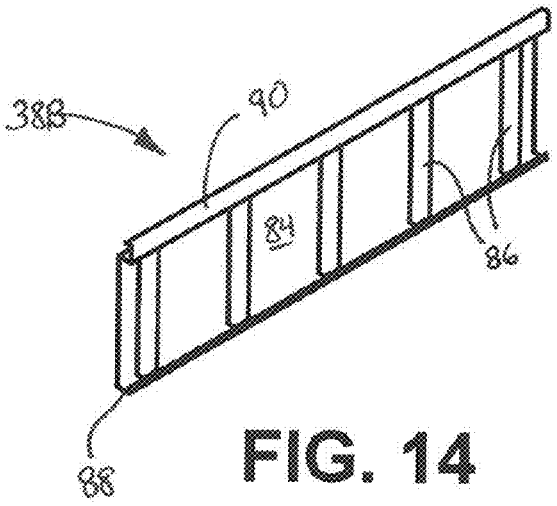
FIG. 14 depicts a ceiling panel used in the metal framework of FIG. 6.

FIGS. 13 and 14 depict exemplary side panels (36A, 36B). The side panels (36A, 36B) are configured for interlocking engagement with one another and securement to the support columns using panel retention brackets (37A, 37B). Each side panel (36A, 36B) comprises a rectangular steel plate (66), a plurality of vertically extending channel members (68) welded to the interior face of steel plate (66) in order to provide rigidity and strength to the side panels. Lower side panel (36A) also includes a horizontally extending channel member (70) along the upper edge of the side panel (36A), as well as a J-shaped flange (72) extending along its lower edge, as shown. Upper side panel (36B) also includes a J-shaped flange (72) extending along its lower edge, and an upper mounting flange (78) extending along its upper edge.

Figure 15:
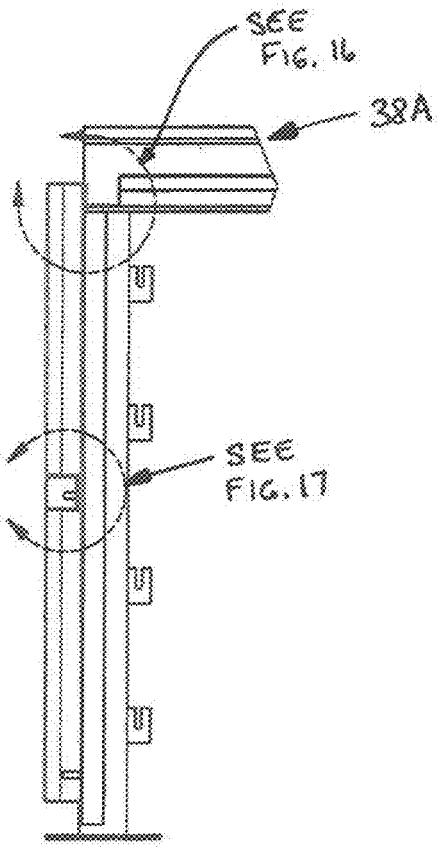
FIG. 15 depicts an end view of a portion of the metal framework of FIG. 6.
Figure 16:
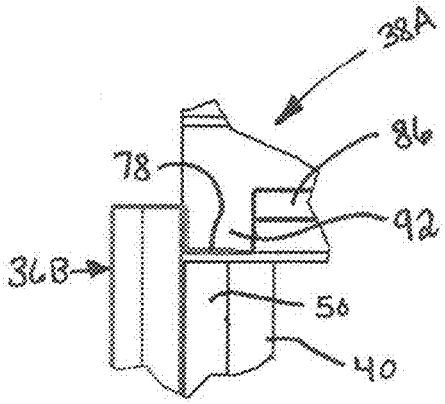
FIG. 16 depicts a magnified end view of a portion of the metal framework illustrated in the inset shown in FIG. 15.
Figure 17:
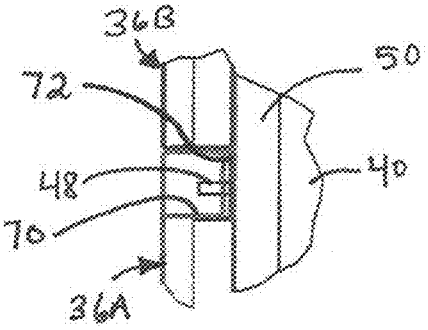
FIG. 17 depicts a magnified end view of a portion of the metal framework illustrated in the inset shown in FIG. 15.
Figure 18:
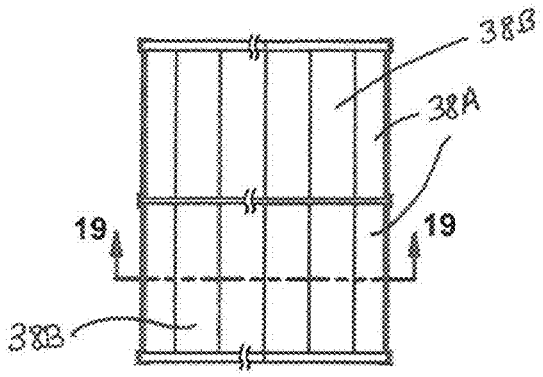
FIG. 18 depicts a top, broken view of the metal framework of FIG. 6.
Figure 19:
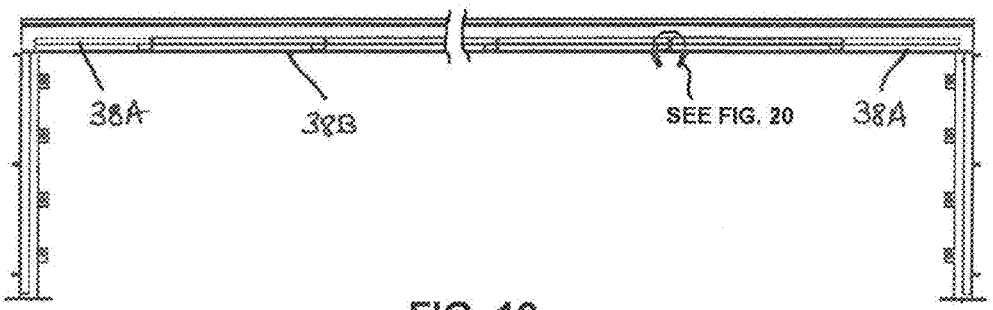
FIG. 19 depicts a cross-sectional view of the metal framework of FIG. 18, taken along the line 19-19 thereof.

The side panels (36) are hung from the upper end of the panel support flanges (50) of the support columns, as best seen in FIGS. 15-17. The upper side panels (36B) are hung first (after the ceiling panels are positioned in place, as discussed below). Each upper side panel (36B) is hung from a pair of adjacent support columns by supporting upper mounting flange (78) on panel support flanges (50) of the support columns, beneath downwardly extending strut (92) of outer ceiling panels (38A) (see FIG. 16). After the upper side panels (36B) are hung from the support columns, the lower side panels (36A) are hung from the upper side panels by positioning channel members (70) of the lower side panels (36A) within the J-shaped flange (72) of the adjacent upper side panel (36B). Thus, J-shaped flange (72) is configured to receive channel member (70) therein, as best seen in FIG. 17. In addition, since a similar J-shaped flange (72) is provided along the lower edge of lower side panel (36A), one or more additional rows of lower side panels (36A) may be hung beneath each row of side panels in the same manner (e.g., as shown in FIG. 6).

Figure 33:
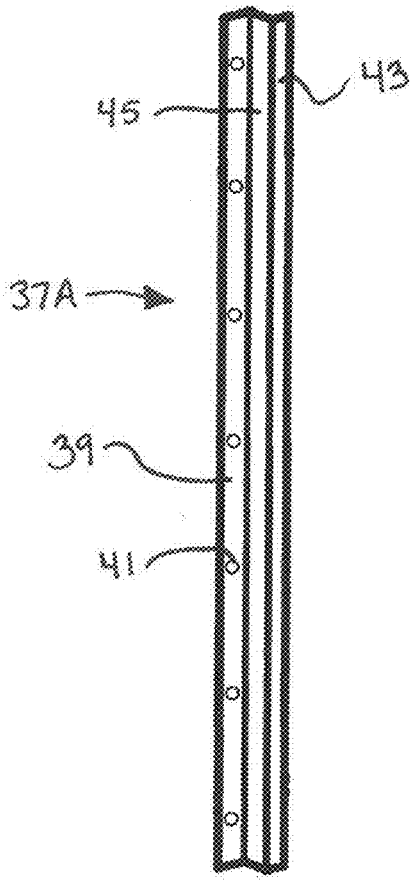
FIGS. 33 and 34 depict two embodiments of panel retention brackets for retaining the side panels on the structure.
Figure 34:
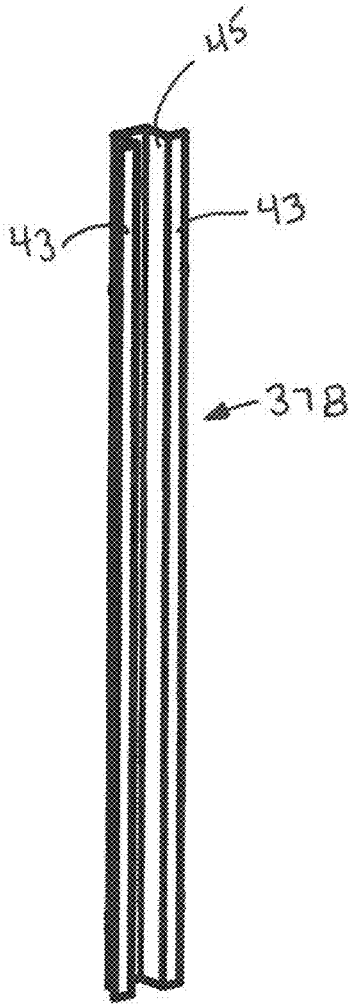

When the side panels (36) are interlockingly hung from the support structure as shown in FIG. 6, the side panels will still freely swing and move on the support structure. With the ceiling panels already in place, the metal framework (30) may be squared using securement rods (62) as described previously. Once square, the side panels are finally secured in place using panel retention brackets (37A, 37B). As best seen in FIGS. 33 and 34, each panel retention bracket (37A, 37B) includes an apertured plate (39) having a series of apertures (41) which are sized and located so as to correspond to threaded mounting studs (48).

Each panel retention bracket (37A, 37B) further includes at least one abutment plate (43) which is spaced away from the aperture plate (39) by a shoulder (45). Outer retention bracket (37A) includes a single abutment plate (43) spaced away from the aperture plate (39) by shoulder (45). Inner retention bracket (37B) includes a pair of abutment plates (43) spaced away from opposite sides of the aperture plate (39) by a pair of shoulders (45). Retention brackets (37A, 37B) are mounted onto a support column by locating apertures (41) of aperture plate (39) over the mounting studs (48) of the support column. This causes abutment plates (43) to abut against the outer surface of a side panel, adjacent an end thereof. Fasteners such as threaded nuts (45) are then used to secure the retention brackets (37A, 37B) in place such that, as the fasteners are tightened, the abutment plates press the side panels against the underlying panel support flanges (50), thereby securing the side panels in place.

Figure 20:
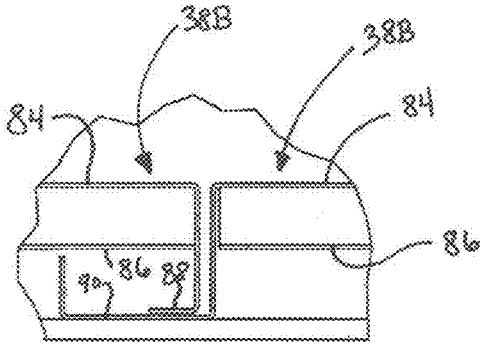
FIG. 20 depicts a magnified cross-sectional view of a portion of the metal framework illustrated in the inset shown in FIG. 19.

The ceiling panels (38) are constructed similar to the side panels, and each comprises a rectangular steel plate (84) and a plurality of laterally extending channel members (86) welded to the bottom face of steel plate (84) in order to provide rigidity and strength to the ceiling panels. The ceiling panels (38) are configured for interlocking engagement with one another, with each ceiling panel including nestable flanges across the sides of the panel (i.e., the nestable flanges extend vertically along the sides of each ceiling panel in the top view of FIG. 18). The ceiling panels are installed before the side panels, beginning with one of the outer, or "starter," ceiling panels (38A). An outer ceiling panel (38A) is slid between an outer cross beam (34A) and a central cross beam (34B) from one side of the framework, with the ceiling panel (34A) supported beneath flanges (60) by I-beam (56) of the cross beams. Thereafter, ceiling panels (38B) are slid into position alongside one another. One side edge of ceiling panel (38B) includes a downwardly extending L-shaped flange (88), and the other side edge of ceiling panel (38B) has a U-shaped flange (90). Adjacent ceiling panels (38B) are engaged with one another by nestably positioning the L-shaped flange (88) in the U-shaped flange (90) of the adjacent ceiling panel (38B) as shown in FIG. 20.

As best seen in FIGS. 15 and 16, instead of an L-shaped or U-shaped flange (88, 90), the outer ceiling panels (38A) include a downwardly extending strut (92) along one side of the ceiling panel. Strut (92) is configured such that upper mounting flange (78) of upper side panel (38A) may be slid beneath the strut (92).

In order to seal the overcast system within the intersection of the mine as well to add additional strength and rigidity, after assembly of the metal framework, a cementitious sealing composition is applied to the metal framework to form the completed overcast system. Typically, the sealing composition is applied to the exterior surfaces of the overcast, as well as along the interior of the overcast (i.e., the tunnel) along the base of the overcaset. However, the cementitious sealing composition may also, or alternatively, be applied to the interior of the overcast. As used herein, a cementitious composition refers to any hydraulically hardenable, cement-based composition comprising cement, water, one or more inert components (e.g., sand and/or other aggregates) and, optionally, one or more adjuvants.

In one embodiment, the cementitious sealing composition comprises: cement, particularly Portland cement (e.g., in conformance with ASTM C150); one or more supplementary cementitious materials, particularly microsilica (also referred to as silica fume) (particularly in conformance with ASTM C1240); sand (e.g., concrete sand, particularly in conformance with ASTM C33); reinforcing fibers; and water. The supplementary cementitious material is used to replace a portion of the cement which would otherwise be necessary, and provides improved performance. Suitable reinforcing fibers include various polymer fibers such as polypropylene or metal fibers (e.g., steel).

One specific embodiment of a cementitious sealing composition comprises, by weight (dry components, without water):

22.5% Portland Cement, Type I/II (ASTM C150)
74.95% Concrete Sand (ASTM C33)
2.5% Microsilica (ASTM C1240)
0.05% Polypropylene fibers The above composition is prepared so as to provide, when hardened, a flexural strength of at least 1,000 psi (28-day flexural strength, ASTM C78), and a 28 day compressive strength of at least 8,000 psi (ASTM C109).

Figure 21:
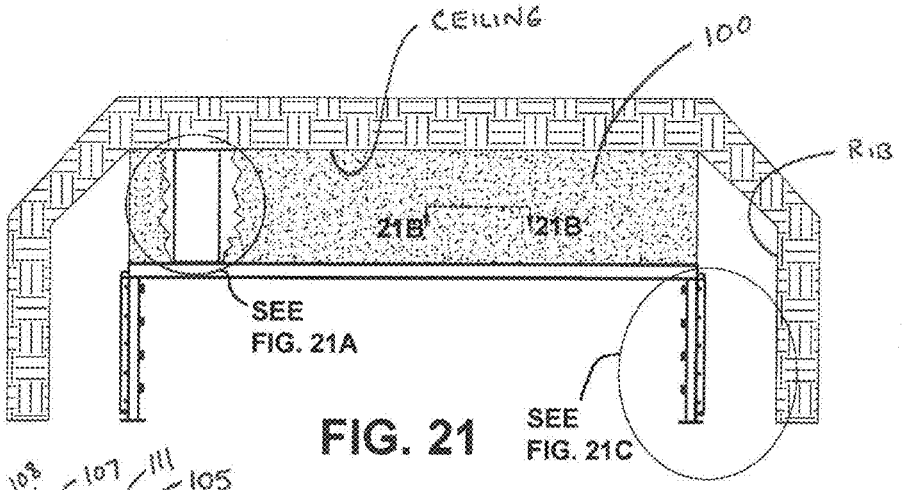
FIG. 21 is an end schematic, partially broken view of an alternative embodiment of a mine ventilation structure installed within a mine, wherein a cementitious sealing composition has been applied to a sealing flange along the upper end of the structure.
Figure 21A:
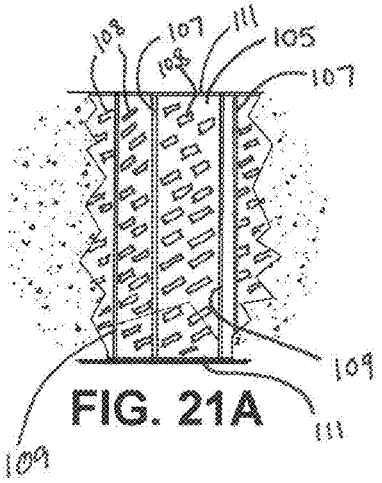
FIG. 21A depicts a magnified view of a portion of the mine ventilation structure illustrated in the inset shown in FIG. 21.
Figure 21B:
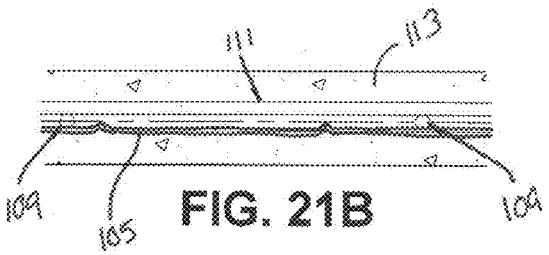
FIG. 21B is a cross-sectional view of a portion of the mine ventilation structure of FIG. 21, taken along the line 21B-21B thereof.
Figure 21C:
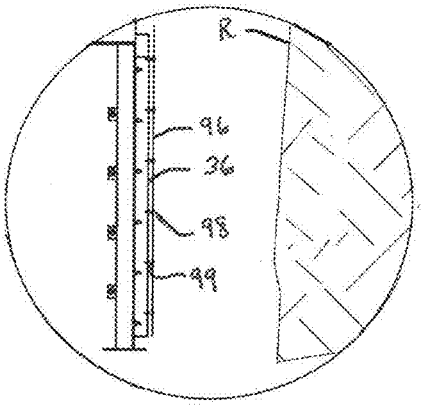
FIG. 21C depicts a magnified view of a portion of the mine ventilation structure illustrated in the inset shown in FIG. 21.

The cementitious sealing composition is applied to the overcast structure by hand (i.e., like conventional concrete or mortar), or as a gunite or shotcrete spray. While the sealing composition, particularly when reinforced with fibers, will stick to the overcast without further modification, the overcast system is advantageously further modified to facilitate adherence of the cementitious sealing composition. In particular, and as depicted in the alternative embodiment of FIG. 21 (particularly FIG. 21C), wire mesh (96) is affixed to one or more of the side and/or ceiling panels such that the wire mesh (96) and the outer surface of the side and/or ceiling panels are in spaced-apart relationship. In the exemplary embodiment of FIG. 21, wire mesh (96) is attached to the side panels (36) using fasteners (98). In this embodiment, fasteners (98) comprise self-tapping screws, with the screws extending through cylindrical spacers (99) positioned between the wire mesh and the side panels in order to provide a gap between the wire mesh and the side panels. Of course the wire mesh may be attached to the panels in spaced-apart relationship in a variety of other ways, such as by using standoffs. In some embodiments, the gap between the wire mesh and the side and ceiling panels is between about 0.5 and about 3 inches, between about 0.5 and about 2 inches, or about one inch. The use of wire mesh not only provides structural support within the hardened cementitious sealing composition, but also allows the sealing composition to flow between the metal mesh and the side and ceiling panels, helping to maintain the sealing composition in place as it hardens. The cementitious sealing composition (e.g. gunnite or shotcrete) is applied over the wire mesh (96), and may extend between the wire mesh and the ribs of the mine passageway. Alternatively, particularly when the distance between the sides of the overcast and the mine ribs is large, a sealing flange structure may be provided in this area, as discussed previously and below.

Figures 23, 23A:
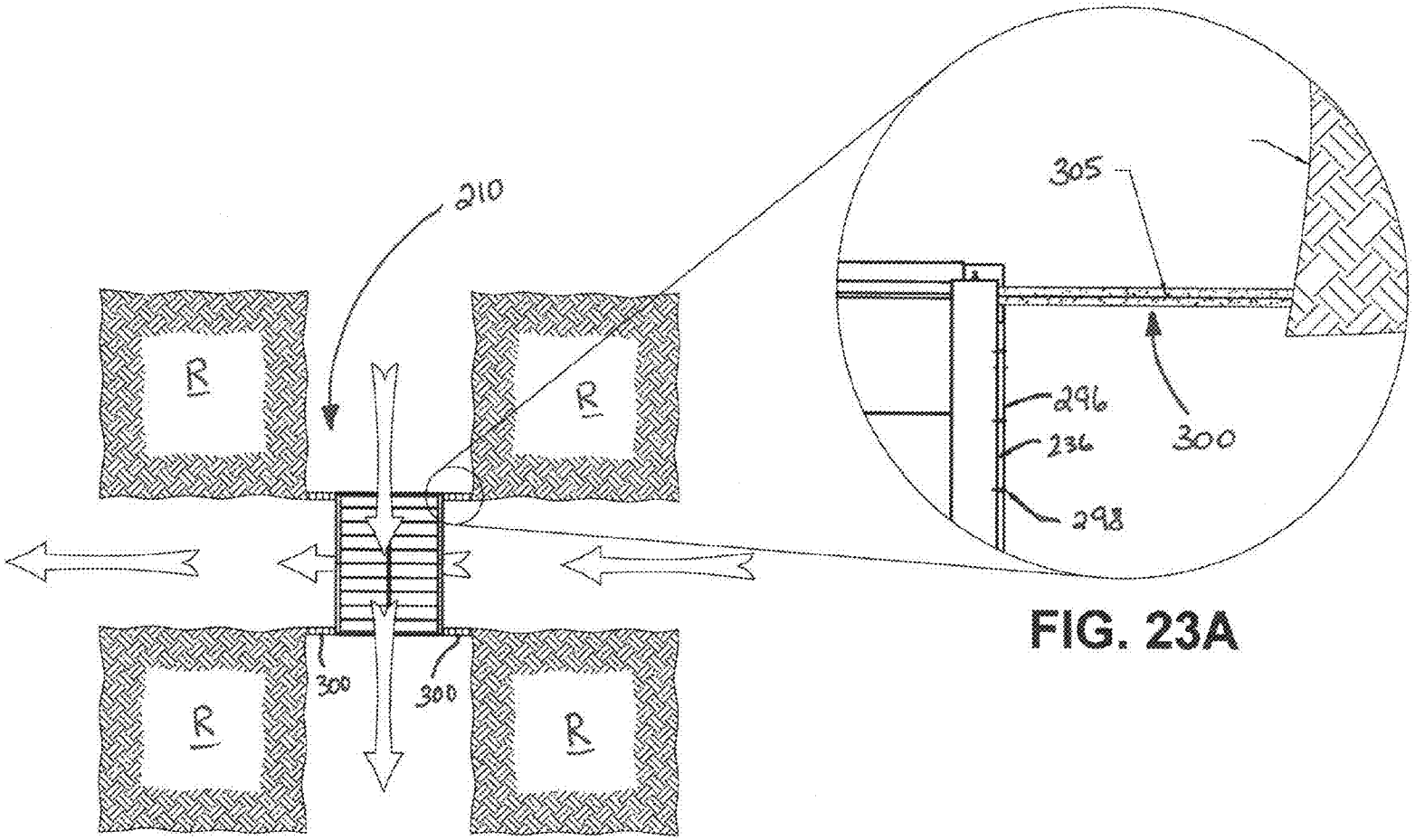
FIG. 23 depicts a top plan view of an alternative embodiment of a mine ventilation structure, installed at the intersection of two mine passageways within a mine.
FIG. 23A depicts a magnified view of a portion of the mine ventilation structure illustrated in the inset shown in FIG. 23.

In order to further facilitate sealing between the overcast system and the ribs and roof of the mine passageways, some embodiments of the metal framework include a sealing flange extending about portions of the framework adjacent the openings to the tunnel T (see FIG. 1). (It should be noted that neither the wire mesh nor the sealing flanges are depicted in FIG. 6.) The sealing flange increases the dimensions of the overcast at at least one of the tunnel entrances, in at least one direction (e.g., the height, width, and/or length). In the example of FIG. 1, the sealing flange (100) extends away from the structure around both tunnel entrances such that the sealing flanges increase the height and width of the overcast in the region adjacent the tunnel openings. In the example of FIG. 23, on the other hand, the sealing flange (300) extends away from the structure around both tunnel entrances such that the sealing flanges increase the length of the overcast in the region adjacent the tunnel openings. Any combination of sealing flange orientations and dimensions may be used to provide adequate sealing within the mine intersection.

The sealing flanges comprise foraminous preform structures which are affixed to the structure about the tunnel entrance(s), and are shaped to provide the necessary dimensions once coated. For example, the foraminous preform structure may be secured to the cross beam (34) adjacent the tunnel entrance and/or the support columns (32) adjacent the tunnel entrance. After the sealing flange preform is affixed adjacent one or both tunnel entrances, the cementitious sealing composition is applied to the preform structure.

In the embodiment of FIG. 1, sealing flange (100) extends about the entire periphery of the entrance and exit of the tunnel T. The preform for sealing flange (100) is provided by foraminous metal structures (e.g., foraminous metal panels) secured to the support columns (32) and outer cross beams (34A) so as to provide the underlying structure of the sealing flanges (100). The foraminous metal panels have sufficient rigidity such that they may be configured to the desired shape for purposes of sealing (when coated with the cementitious sealing composition) so as to seal the overcast structure to the ribs and roof of the mine passageways, as necessary. The preform is shaped into the desired configuration for sealing flange (100), and then the cementitious sealing composition is applied to the preform to form the sealing flange (100)

Suitable materials for the foraminous metal panels include expanded metal lath, particularly expanded metal which is corrugated or ribbed to provide additional strength (also referred to as rib lath). One suitable material is STAY-FORM® galvanized carbon steel sheet available from Alabama Metal Industries Corporation, Birmingham, Ala. The foraminous metal panels are secured to the metal framework using, for example, self-tapping screws are other suitable fasteners. Additional reinforcement, particularly rebar may be positioned within the sealing flanges, as necessary, particularly if the sealing flange will span a significant distance from the metal framework to the rib or ceiling of the mine passageway.

Figure 22A:
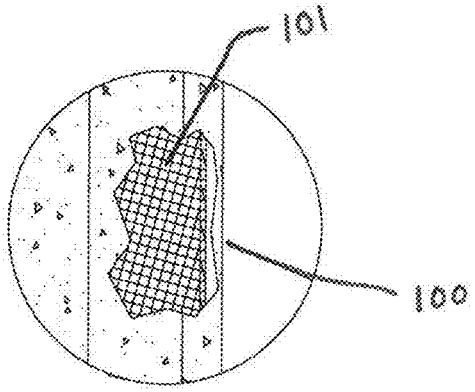
FIG. 22A depicts a magnified view of a portion of the mine ventilation structure illustrated in the inset shown in FIG. 1, wherein a portion of the cementitious sealing composition is removed in order to depict the underlying sealing flange.
Figure 22B:
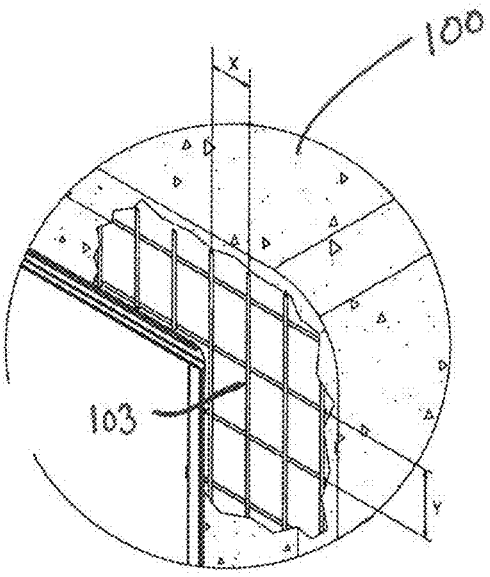
FIG. 22B depicts a magnified view of a portion of the mine ventilation structure illustrated in the inset shown in FIG. 1, wherein a portion of the cementitious sealing composition is removed in order to depict an alternative embodiment of the underlying sealing flange.

In the inset view of FIG. 22A, sealing flange (100) is formed from metal lath which has been shaped into the form of sealing flange (100) and then sprayed with gunnite. In the inset view of FIG. 22B, sealing flange (100) is formed from rebar mat which has been shaped into the form of sealing flange (100) and then sprayed with gunnite.

It will be understood that sealing flange (100) may include more than one type of foraminous metal panel. For example, as shown in the inset view of FIG. 21A and the cross-sectional view of FIG. 21B, the sealing flange in this embodiment comprises corrugated metal lath (105) having corrugations (107) and apertures (108) (e.g., STAY-FORM® galvanized carbon steel sheet), as well as rebar (109, 111) (i.e., vertical rebar (109) and horizontal rebar (111)). Reinforcing rebar may be provided on either or both sides of the metal lath or other foraminous metal panels. The thus-formed sealing flange is then sprayed with gunnite (113) in order to seal the flange to the ceiling and/or ribs of the mine passageways. It will be understood that a cementitious sealing composition (e.g., gunnite) is also applied between the wire mesh (96)

FIG. 23 depicts another alternative embodiment of an overcast system (210) installed in an intersection within a mine. In this embodiment, sealing flanges (300) extends away from the overcast parallel to the tunnel direction beneath the overcast (in FIG. 1 the sealing flanges (100) extend perpendicular to the tunnel T). In other words, sealing flanges (300) Sealing flange (300) includes corrugated metal lath secured to the exterior of the overcast, as shown in FIG. 23A. The corrugated metal lath is then sprayed with gunnite or shotcrete to seal the overcast to the ribs (R) of the mine passageways. Wire mesh (296) is also affixed the side panels (236) using fasteners (98), and subsequently sprayed with gunnite or shotcrete.

Figure 24:
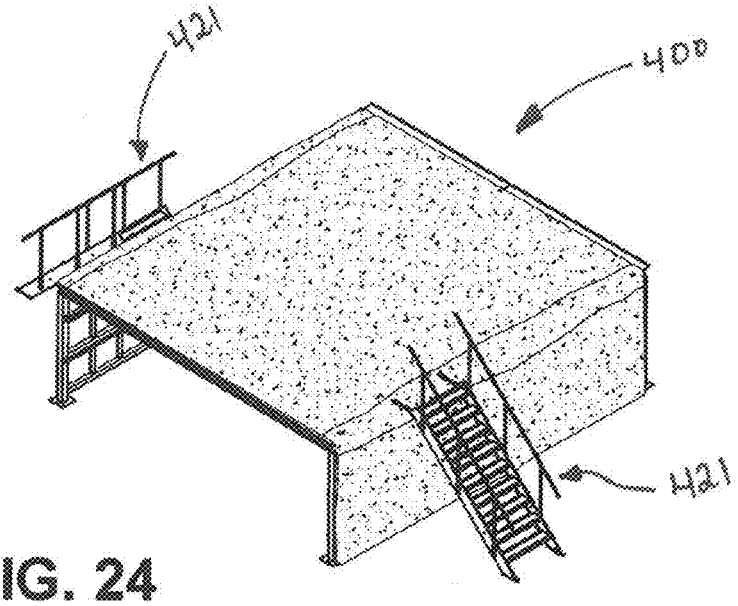
FIG. 24 depicts a schematic view of yet another alternative embodiment of a mine ventilation structure, wherein a stair assembly is mounted on each side of the structure.
Figure 25:
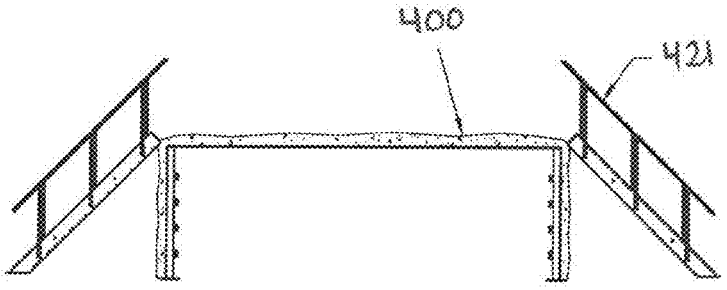
FIG. 25 is an end view of the embodiment shown in FIG. 24.
Figure 26:
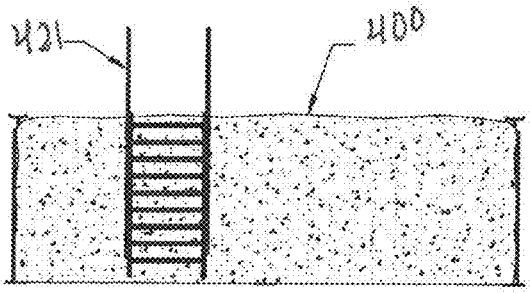
FIG. 26 is a side view of the embodiment shown in FIG. 24.

The mine ventilation structures of described herein may also be provided with various additional features. FIGS. 24-26, for example, depict overcast system (400), coated with a cementitious sealing composition, along with a pair of stair assemblies (421) attached on either side of the overcast system. Because of the additional strength and rigidity provided by the cementitious coating, the upper surface of the overcast may be used as a walkway, hence the stair assemblies providing access to the upper surface of the coated overcast.

Figure 27:
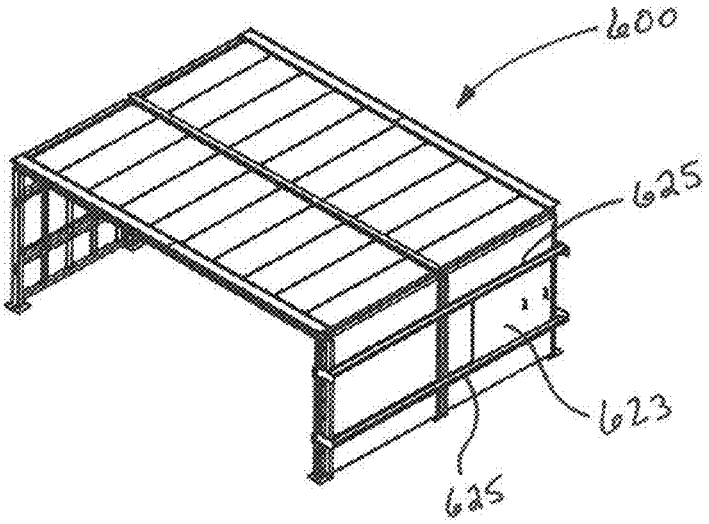
FIG. 27 depicts a schematic view of another alternative embodiment of a mine ventilation structure, wherein a sliding regulator door is mounted on one side of the structure.
Figure 28:
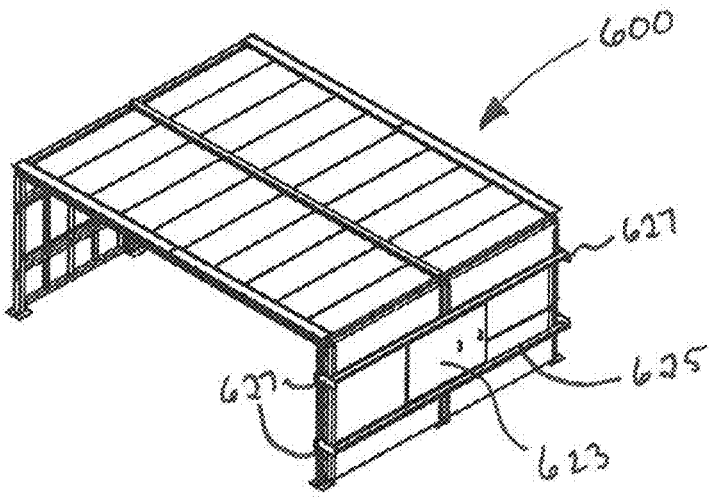
FIG. 28 depicts the embodiment of FIG. 27, wherein the regulator door is shown in the open position.

FIGS. 27 and 28 depict an overcast assembly (600) in uncoated form, which includes a sliding regulator door (623) mounted on one side of the framework. If desired, a regulator door may be provided on the opposite side as well. The regulator door may be opened and closed to any desired extent in order to regulate airflow therethrough. Regulator door (627) is slidably mounted on a pair of slide channels (625) which are in turn mounted to the outer support columns using flanges (627) located at the ends of the slide channels (625) (e.g., using threaded fasteners). A portion of the side panel adjacent the regulator door is also omitted in this embodiment in view of the regulatory door being present. Following assembly of overcast (600) within the mine location, the regulator door is blocked off (covered) prior to applying the cementitious composition such that the regulator door remains exposed.

Figure 29:
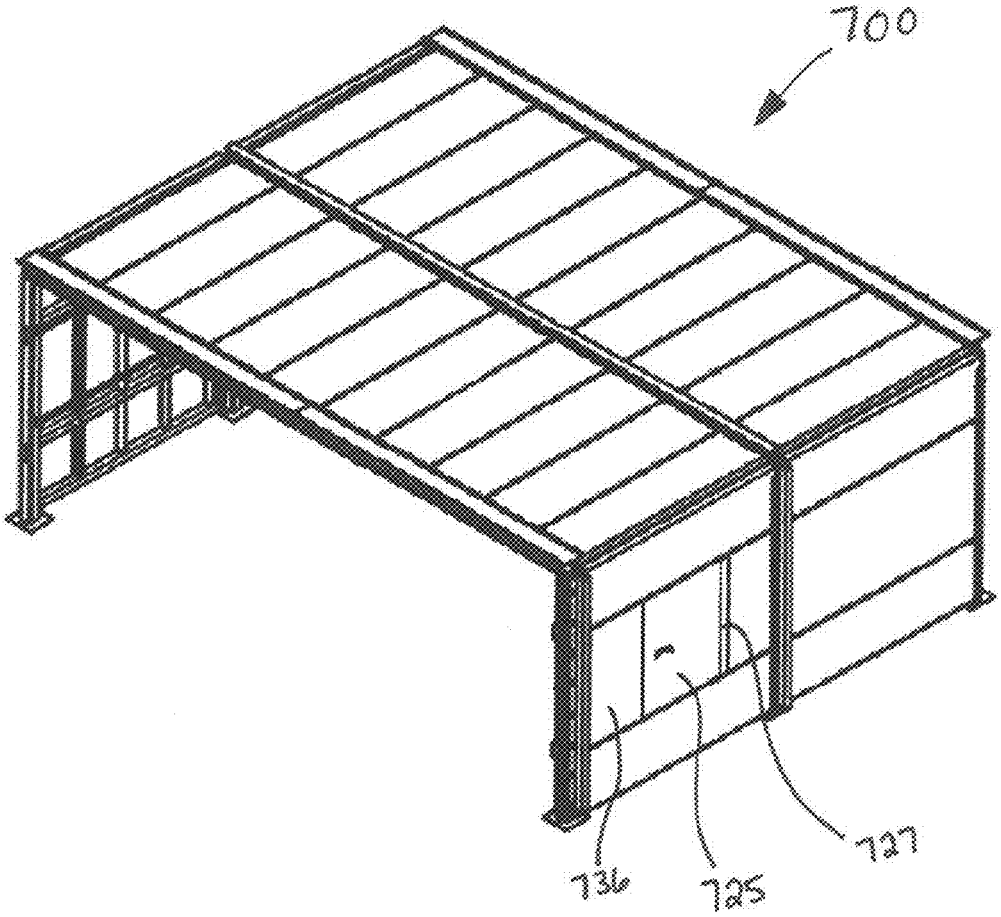
FIG. 29 depicts a schematic view of an additional alternative embodiment of a mine ventilation structure, wherein an access door is mounted on one side of the structure.

FIG. 29 depicts yet another overcast assembly (700), in uncoated form, which includes a hinged door (725), hingedly connected along side (727). Door (725) is incorporated into side panel (736), and provides access to the tunnel beneath overcast (700). Once again the hinged access door (725) is blocked off (covered) prior to applying the cementitious composition such that the door remains exposed. sliding regulator door (623) mounted on one side of the framework. If desired, a door may be provided on the opposite side of the overcast as well.

Figure 30:
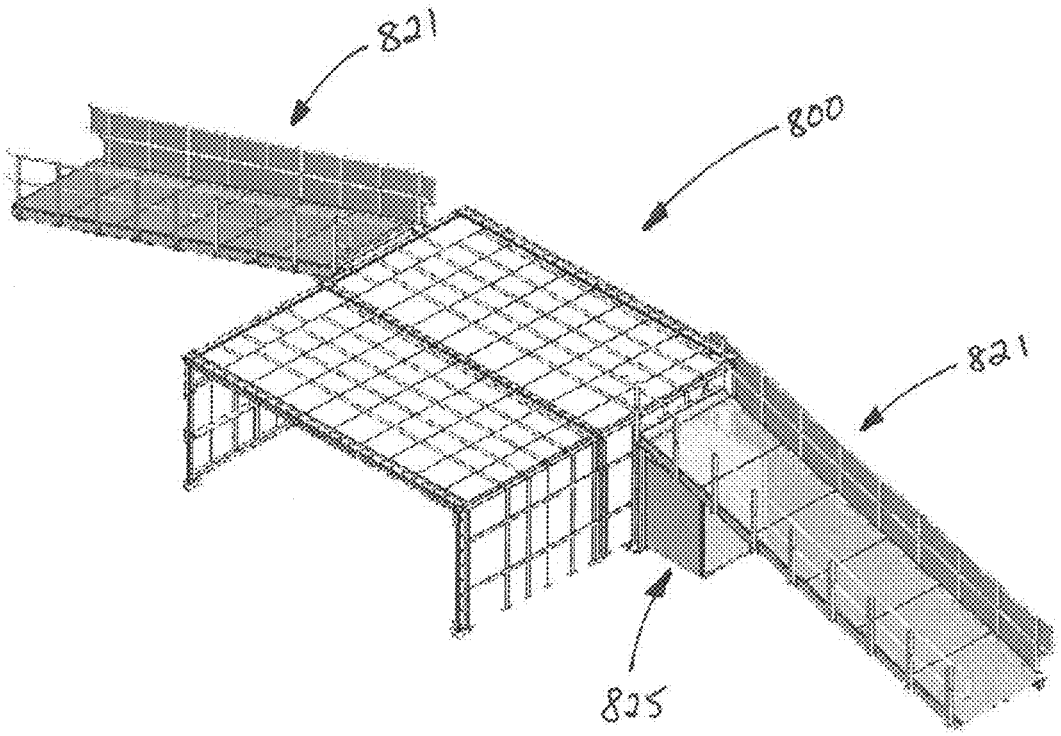
FIG. 30 depicts a schematic view of another alternative embodiment of a mine ventilation structure, wherein a ramp assembly is mounted on each side of the structure along with an airlock assembly located beneath one of the ramps.
Figure 31:
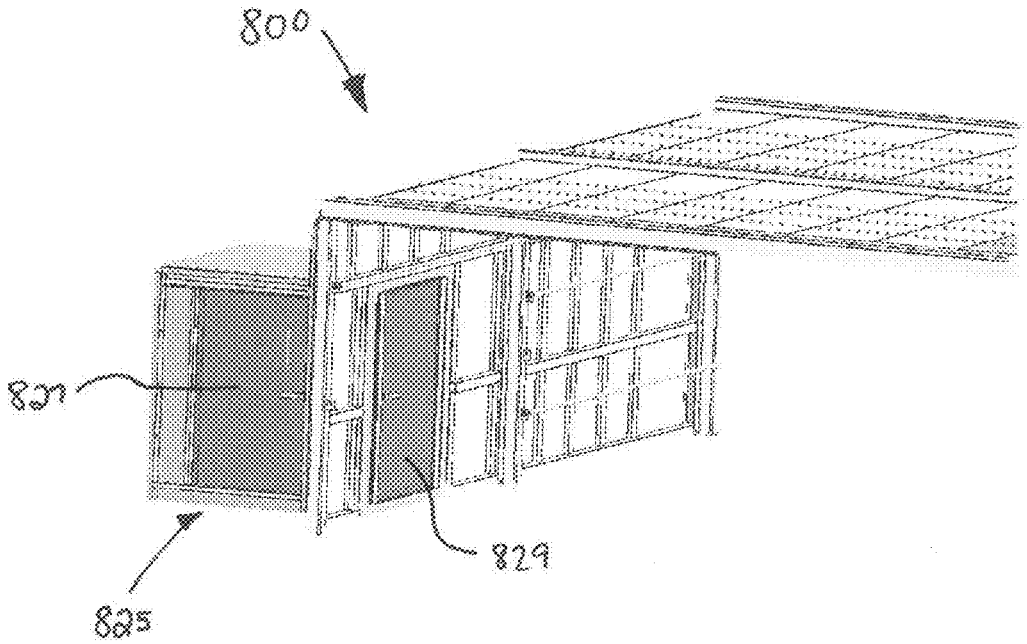
FIG. 31 depicts a schematic view of another alternative embodiment of a mine ventilation structure, wherein an airlock assembly is mounted on one side of the structure.

FIG. 30 depicts another embodiment of an overcast assembly (800), in uncoated form, along with a pair of ramp assemblies (821) attached on either side of the overcast system and an airlock assembly (825) located beneath one of the ramp assemblies. Because of the additional strength and rigidity provided by the cementitious coating, the upper surface of the overcast may be used as a walkway, hence the ramp assemblies providing access to the upper surface of the coated overcast. FIG. 31 provides additional details regarding the airlock assembly (825), wherein the ramp assembly has been omitted for clarity. As noted in FIG. 31, the airlock assembly replaces portions of one or more side panels, and includes an exterior door (827) providing access to the airlock interior, and an internal door (829) providing access between the airlock and the interior of the tunnel beneath the overcast.

Figure 32:
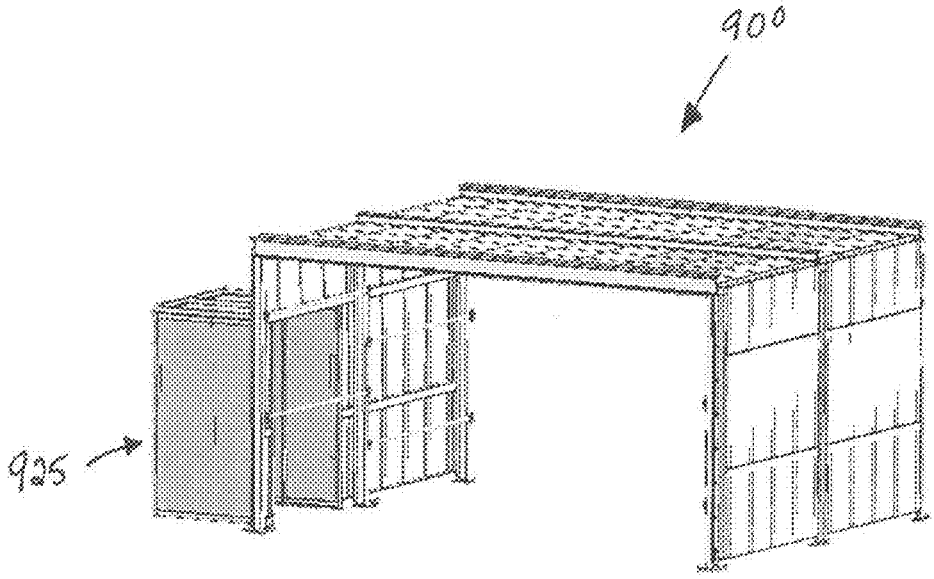
FIG. 32 depicts a schematic view of another alternative embodiment of a mine ventilation structure, wherein a man hole assembly is mounted on one side of the structure.

Finally, FIG. 32 depicts an embodiment wherein a man hole assembly (925) replaces portions of one or more side panels, and may be used for haulage entry into the tunnel beneath the overcast.

While several devices and components thereof have been discussed in detail above, it should be understood that the components, features, configurations, and methods of using the devices discussed are not limited to the contexts provided above. In particular, components, features, configurations, and methods of use described in the context of one of the devices may be incorporated into any of the other devices. Furthermore, not limited to the further description provided below, additional and alternative suitable components, features, configurations, and methods of using the devices, as well as various ways in which the teachings herein may be combined and interchanged, will be apparent to those of ordinary skill in the art in view of the teachings herein.

Having shown and described various versions in the present disclosure, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A mine ventilation structure comprising:

(a) a metal support structure comprising a plurality of support columns and a plurality of cross beams, each of said cross beams extending between a pair of support columns located on opposite sides of the support structure;

(b) a plurality of metal side panels mounted directly on said support columns and a plurality of ceiling panels mounted on said cross beams; and (c) a cementitious sealing composition applied over at least one surface of the side or ceiling panels;

wherein said side and ceiling panels are arranged so as to provide a tunnel beneath said ceiling panels and bounded on either side by said side panels, the tunnel having first and second entrances opposite one another, said structure further comprising a sealing flange extending away from the perimeter of at least one of said tunnel entrances.

2. The mine ventilation structure of claim 1, wherein said sealing flange comprises a foraminous, metal preform structure underlying said cementitious sealing composition.

3. The mine ventilation structure of claim 2, wherein said sealing flange extends away from at least one of said tunnel entrances such that the sealing flange increases the dimension of the mine ventilation structure at said at least one of the tunnel entrances in at least one direction.

4. The mine ventilation structure of claim 2, wherein said sealing flange comprises a foraminous preform structure affixed to and extending away from said metal support structure.

5. The mine ventilation structure of claim 4, further comprising wire mesh affixed to one or more of said side panels, wherein said wire mesh is spaced apart from the outer surface of the side panels, and further wherein said cementitious sealing composition is applied over at least a portion of said wire mesh.

6. The mine ventilation structure of claim 2, wherein said sealing flange preform comprises expanded metal lath affixed to and extending away from said metal support structure.

7. The mine ventilation structure of claim 6, wherein said expanded metal lath is corrugated.

8. The mine ventilation structure of claim 2, wherein said sealing flange preform comprises rebar mat affixed to and extending away from said metal support structure.

9. The mine ventilation structure of claim 1, further comprising mesh affixed to one or more of said side and/or ceiling panels, wherein said cementitious sealing composition is applied over at least a portion of said mesh.

10. The mine ventilation structure of claim 1, wherein said cementitious sealing composition comprises reinforcing fibers.

11. A method of assembling and sealing an overcast in an intersection within a mine, comprising:

(a) erecting a support structure within the mine intersection;

(b) mounting a plurality of metal side panels and metal ceiling panels directly onsaid support structure, such that a tunnel is provided beneath the ceiling panels and bounded on either side by the side panels, the tunnel having first and second entrances opposite one another, wherein the overcast includes a foraminous sealing flange preform which extends away from at least one of said tunnel entrances such that the sealing flange increases the dimension of the mine ventilation structure at said at least one of the tunnel entrances in at least one direction; and (c) applying a cementitious sealing composition applied over at least one surface of the side or ceiling panels, as well as the sealing flange preform in order to fill the space between the sealing flange preform and a wall of the mine.

12. The method of claim 11, further comprising the step of affixing the foraminous sealing flange preform to the overcast such that the flange preform extends from the outer perimeter of the tunnel entrance towards the mine walls and mine ceiling adjacent the tunnel entrance of the overcast.

13. The method of claim 12, wherein said step of applying a cementitious sealing composition comprises spraying gunnite or shotcrete over at least one surface of the side or ceiling panels and the sealing flange preform.

14. The method of claim 11, wherein said step of applying a cementitious sealing composition comprises spraying gunnite or shotcrete over at least one surface of the side or ceiling panels and the sealing flange preform.

15. The method of claim 11, further comprising the step of affixing wire mesh to one or more of said side panels, wherein said wire mesh is spaced apart from the outer surface of the side panels, and further wherein said cementitious sealing composition is applied over at least a portion of said wire mesh.

16. A mine ventilation structure comprising:

(a) a metal support structure comprising a plurality of support columns and a plurality of cross beams, each of said cross beams extending between a pair of support columns located on opposite sides of the support structure;

(b) a plurality of metal side panels mounted directly on said support columns and a plurality of ceiling panels mounted on said cross beams;

(c) metal mesh affixed to one or more of said side and/or ceiling panels such that that the mesh and the outer surface of the panels are in spaced-apart relationship; and (d) a cementitious sealing composition applied over said metal mesh;

wherein said side and ceiling panels are arranged so as to provide a tunnel beneath said ceiling panels and bounded on either side by said side panels, the tunnel having first and second entrances opposite one another.

* * * * *